US006634262B2

(12) United States Patent
Malchus

(10) Patent No.: US 6,634,262 B2
(45) Date of Patent: Oct. 21, 2003

(54) RATCHET WRENCH FOR STORAGE OF NESTED SOCKETS

(75) Inventor: Darin Malchus, West Jordan, UT (US)

(73) Assignee: Nebo Products, Inc., Draper, UT (US)

( * ) Notice: Subject to any disclaimer, the term of this patent is extended or adjusted under 35 U.S.C. 154(b) by 148 days.

(21) Appl. No.: 09/928,079

(22) Filed: Aug. 10, 2001

(65) Prior Publication Data

US 2003/0029284 A1 Feb. 13, 2003

(51) Int. Cl.[7] ..... B25G 1/08
(52) U.S. Cl. ..... 81/490; 81/177.4
(58) Field of Search ..... 81/490, 492, 177.4

(56) References Cited

U.S. PATENT DOCUMENTS

| | | | | | |
|---|---|---|---|---|---|
| 1,563,178 | A | | 11/1925 | Fegley et al. | 74/124 |
| 4,170,909 | A | | 10/1979 | Wagner | 81/63.2 |
| 4,235,269 | A | | 11/1980 | Kraus | 81/438 |
| 4,253,356 | A | * | 3/1981 | Martinmaas | 81/177.4 |
| 4,302,990 | A | | 12/1981 | Crichton et al. | 81/60 |
| 4,352,306 | A | | 10/1982 | Martinmaas | 81/177.4 |
| 4,352,307 | A | * | 10/1982 | Martinmaas | 81/177.4 |
| RE31,140 | E | * | 2/1983 | Martinmaas | 81/177.4 |
| 4,372,361 | A | | 2/1983 | Whiteford | 81/177.4 |
| 4,376,397 | A | | 3/1983 | Newby et al. | 81/177.2 |
| D270,227 | S | | 8/1983 | Roth et al. | D8/25 |
| 4,468,990 | A | | 9/1984 | Hile | 81/60 |
| 4,488,460 | A | | 12/1984 | Ballone et al. | 81/60 |
| 4,489,628 | A | | 12/1984 | Nicastro | 81/185 |
| 4,541,310 | A | | 9/1985 | Lindenberger | 81/60 |
| 4,627,315 | A | | 12/1986 | Lin | 81/177.4 |
| D290,581 | S | | 6/1987 | Hughes | D8/347 |
| D310,770 | S | | 9/1990 | Zamarripa | D8/29 |
| 4,960,016 | A | | 10/1990 | Seals | 81/177.4 |
| D334,519 | S | | 4/1993 | Arnold | D8/51 |
| 5,280,740 | A | | 1/1994 | Ernst | 81/177.7 |
| D374,387 | S | | 10/1996 | Schaffer | D8/82 |
| 5,632,186 | A | | 5/1997 | Lin | 81/59.1 |
| D394,993 | S | | 6/1998 | Ashby | D8/25 |
| D400,066 | S | | 10/1998 | Kelsey et al. | D8/14 |
| D403,934 | S | | 1/1999 | Girdler et al. | D8/27 |
| 6,199,454 | B1 | | 3/2001 | Bergbower | 81/60 |
| 6,349,623 | B1 | | 2/2002 | Peters | 81/177.4 |
| 6,401,577 | B1 | | 6/2002 | Peters | 81/177.4 |

* cited by examiner

*Primary Examiner*—Joseph J. Hail, III
*Assistant Examiner*—David B. Thomas
(74) *Attorney, Agent, or Firm*—Stoel Rives LLP

(57) ABSTRACT

A ratchet wrench with a wrench head, a handle and a tray provides compact and easily accessible storage of sockets. The handle defines a chamber in which the tray is stored. The tray has a back side and a stepped slot shaped and sized to retain sets of nested sockets. The tray defines at least one aperture which corresponds with the storage position of a first socket in each set of nested sockets. The aperture provides access to the first socket from the back side of the tray and facilitates dislodging of the first socket. Once the first socket is dislodged, the entire set of nested sockets is easily removed.

22 Claims, 6 Drawing Sheets

RATCHET WRENCH FOR STORAGE OF NESTED SOCKETS

TECHNICAL FIELD

The present invention is related to an improved wrench for storing sockets. More particularly, the wrench of the present invention compactly stores exchangeable sockets on a tray that is inserted into the handle of the wrench.

BACKGROUND OF THE INVENTION

Handtools with handles that store tool members, such as sockets, are well known in the prior art. Of these handtools, none store sockets in as compact, durable and easily accessible manner as is desired. For example, U.S. Pat. No. 4,960,016 issued to Seals discloses a handtool in which tool members are threaded onto a screwdriver shaft for storage. The screwdriver shaft can be inserted into the handle of the tool. While this handtool may store tool members compactly, the tool members are not easily accessible because all tool members may need to be removed to access a tool member at the base of the shaft.

Other hand tools in the prior art store sockets singly in separate compartments or on separate mounting stubs. While storing sockets in separate compartments provides access to sockets individually, the sockets are not stored in a compact arrangement. As a result, the handle of the tool must be larger and more unwieldy than is desirable. Further, handtools storing sockets singly include a grasping clip or mounting stub for each individual socket, parts that may be broken off the tool. For example, U.S. Pat. No. 4,302,990 issued to Crichton et al. discloses a socket wrench with lips that hold sockets. Further, a handtool that stores tool members singly may have to hold the single tool member so firmly as to make removal difficult.

What is needed in the art is a wrench that store sockets in a compact, but easily accessed and easily loaded manner. What is also needed is a wrench that can retain sockets in place during handling, without outwardly extending stubs or lips that can be broken off.

SUMMARY OF THE INVENTION

It is therefore, an object of the present invention is to provide storage of sockets in a relatively secure and compact manner.

Another object of the present invention is to provide storage of sockets in a easily accessed and easily loaded manner.

Another object of the present invention to provide a wrench that stores sockets in its handle to avoid losing or misplacing the sockets.

A further object of the present invention is to provide storage of sockets on a tray, without the need for extensions or lips that could be broken off the tray.

To achieve the foregoing objects, and in accordance with the invention as embodied and broadly described herein, a wrench that stores sockets in the handle of the wrench is provided. The wrench has three main components: a head, a handle, and a tray adapted to retain sockets. The handle may be connected to the head via a pivot pin or via a neck. The handle defines a chamber into which the tray may be inserted.

The tray is inserted into the chamber of the handle during storage and use. The tray and chamber have corresponding cylindrical shapes. In addition, the tray is tapered at the insertion end to correspond with a curved region of the handle. The curved shape of the handle enables the handle to be easily grasped.

The tray and handle are adapted to securely engage the tray and handle together, keeping the tray inside the handle until removal is desired. The tray has an engagement end opposite from an insertion end. In a preferred embodiment, the engagement end and the chamber have corresponding threads to secure the tray inside the chamber. In an alternative embodiment, the engagement end and the tray have corresponding ribs to secure the tray inside the chamber. Alternatively, the chamber may have a tapered shape that retains the tray inside the chamber. Also, the tray, particularly the insertion end, may be adapted to interlock with a corresponding portion of the chamber.

When the tray is removed from the chamber, the sockets are retained relatively securely and are easily removed from the tray. The tray has an open side, a back side and a stepped slot adapted to retain at least a first set of nested sockets until removal is desired. The stepped slot is accessible from the open side of the tray. Storing sockets in a stepped slot keeps the sockets visible and accessible from the open side of the tray. A further advantage of storing sockets in a stepped slot is that the tray retains sockets without lips or other extensions that could be broken off the tray.

In a preferred embodiment, the stepped slot is divided into three cells, each cell being separated from the adjoining cell by a divider. The divider may be a platform running from one edge of the tray to the other or ledges extending from the sides of the tray into the cell. An advantage of this feature is that the divider may help retain the nested sockets in the tray even when one socket becomes partially dislodged.

Each cell in the stepped slot has a narrow receptacle and a wide receptacle that together receive and grip a set of nested sockets. Each receptacle is sized and shaped to support and grip a socket. In the preferred embodiment, each receptacle is molded to fit a socket of corresponding size enabling each receptacle to grip a socket.

In one embodiment, each receptacle grips the respective sockets with approximately equal force. In alternative embodiments, only one of the receptacles of a cell is adapted to grip a socket in the set of nested sockets. In another embodiment, one receptacle provides a tighter grip on the socket retained in it that the other receptacle. The receptacles may be tapered to provide a frictional engagement with the sockets. The receptacles may also be slightly flexible and sized slightly smaller than the respective sockets so that the sidewalls of the receptacles flex upon insertion of the socket and grip the sockets. Any kind of frictional engagement may be utilized. The receptacles grip the sets of nested sockets sufficiently tightly so that the set of sockets remains in the tray during handling and even when the tray faces downward.

By storing sockets in a nested configuration, the sockets are retained compactly and relatively securely while still being easy to remove. In one embodiment, the narrow receptacle may exert a greater grip on its corresponding socket than the grip exerted by the wide receptacle on a larger socket, allowing the set of nested sockets to be relatively securely retained but easily removable. The larger, less tightly gripped socket can be easily dislodged, by being pushed or pulled out of the wide receptacle. The smaller, more tightly gripped socket will remain gripped by the tray until the larger socket swings away from the tray, bringing the smaller, nested socket out of the grip of the narrow receptacle. As addressed above, storing sets of nested sockets allows the tray to securely retain the sockets while also providing for easy removal. Another of advantage of this feature is that nested sockets may also be stored more compactly than sockets stored singly.

Each cell stores sets of sockets having a size ratio of one socket to another that is sufficient to enable one socket to be nested in another socket. A socket to have another socket nested in it, preferably has a size ratio of approximately 1.5:1 to 2:1, more preferably 1.6:1 to 1.75:1. However, the ratio may be greater than 2:1. The tray of the preferred embodiment stores three pairs of nested sockets of the following sizes: (1) a 9/16 socket and a 11/32 socket, which is a 1.6:1 ratio; (2) a ½ socket and a 5/16 socket, which is a 1.6:1 ratio; and (3) a 7/16 socket and a ¼ socket, which is a 1.75:1 ratio.

In a preferred embodiment, removal of the sockets is facilitated by three apertures defined by the tray. The apertures are positioned to expose one socket in every set of nested sockets through the back side of the tray. The aperture allows the exposed socket to be pushed from the back side of the tray. As discussed above, once one socket in the set of nested sockets is dislodged, the set of nested sockets can be easily grasped and pivoted out of the tray. In an alternative embodiment, the tray defines no apertures and the sockets are not exposed through the back side of the tray. The sets of nested sockets are removed by pulling the larger of the sockets from the tray.

The head of the wrench has a socket mounting stub and ratcheting mechanism. The head is connected to the handle by a pivot pin that allows the head to pivot relative to the handle. The head has a base that is pivotable when a ball bearing is moved away from the base. The ball bearing is moved away by the operation of a pivot arm. The pivot arm is propped open by a spring. When the pivot arm is depressed, the ball bearing drops into a notch in the pivot arm, enabling the base and attached head to pivot relative to the handle.

These and other objects and features of the present invention will become more fully apparent from the following description and appended claims, or may be learned by the practice of the invention as set forth hereunder.

BRIEF DESCRIPTION OF THE DRAWINGS

A more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The present invention is directed to an improved wrench that stores sockets inside its handle. More particularly, the wrench has a handle that defines a chamber and a tray that is inserted into the chamber. The tray is adapted to retain sockets in nested sets, a configuration that enables the set of nested sockets to be compactly and relatively securely stored but easily removed when desired.

Figure 1:
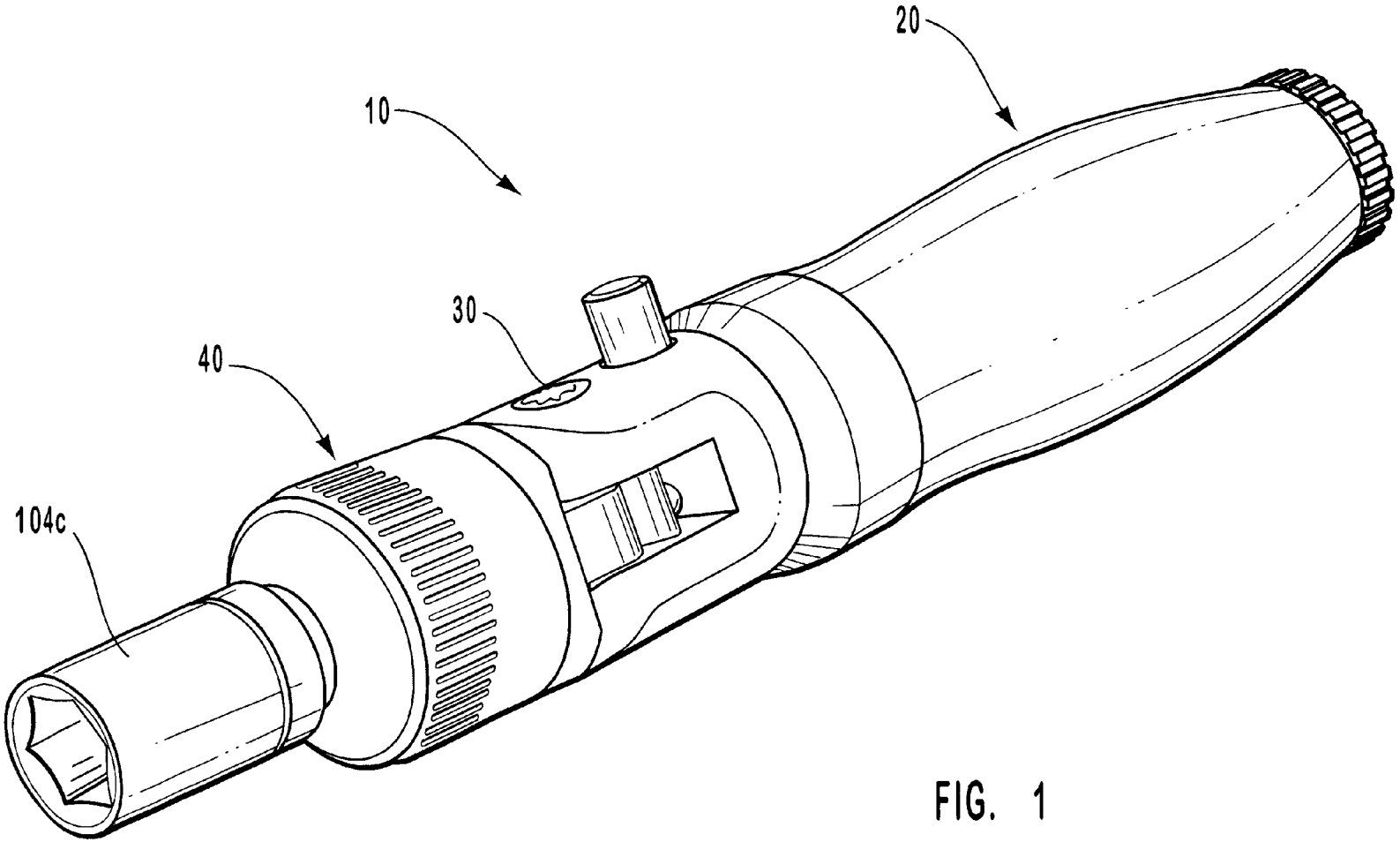
FIG. 1 is an assembled perspective view illustrating an embodiment of the present invention.
Figure 2:
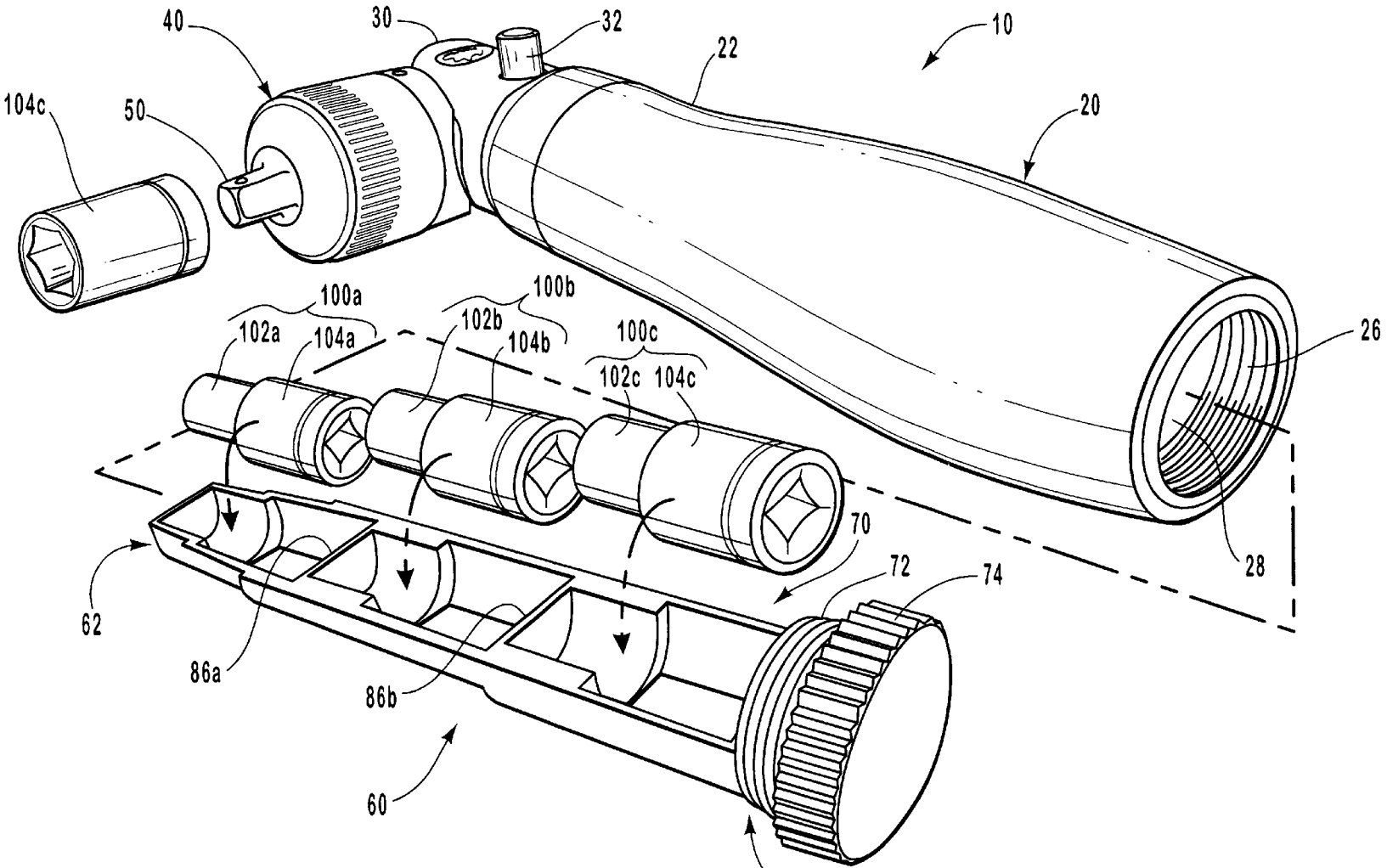
FIG. 2 is an exploded perspective view of an embodiment of the present invention, showing the tray and the storage arrangement of nested sockets.

FIGS. 1 and 2 illustrate a preferred embodiment of the present invention, a ratchet wrench 10. Ratchet wrench 10 has three main components: a head 40; a handle 20 connected to head 40; and a tray 60 adapted to retain sockets 102*a*, 104*a*, 102*b*, 104*b*, 102*c*, 104*c* (collectively and generically 100). Handle 20 defines a chamber 28 into which tray 60 is inserted. Tray 60 and handle 20 are adapted so that tray 60 remains securely inside handle 20 until removal is desired. Tray 60 has an open side 66, a back side 68 and a stepped slot 70 that is adapted to store sockets 100 in a nested configuration and is accessible from open side 66 of tray 60. Storing sockets 100 in a nested configuration allows sockets 100 to be retained relatively securely in tray 60 while allowing sockets 100 to be easily removed when desired.

Figure 3C:
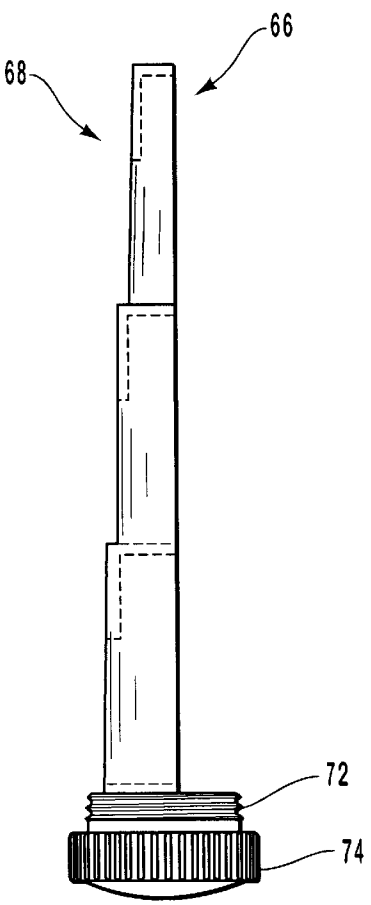
FIG. 3C is a side view of the tray of an embodiment of the present invention.
Figure 3B:
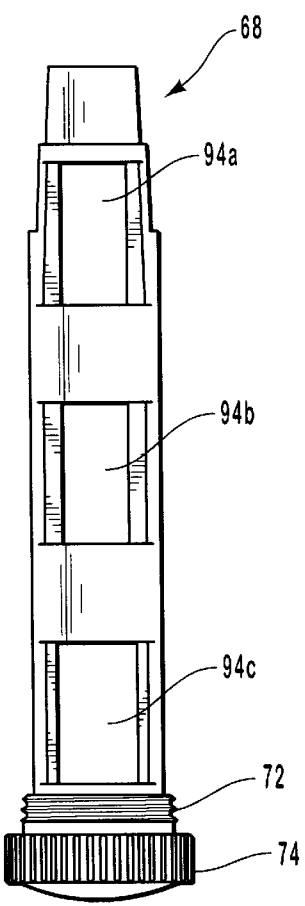
FIG. 3B is a back view of the tray of an embodiment of the present invention.
Figure 3A:
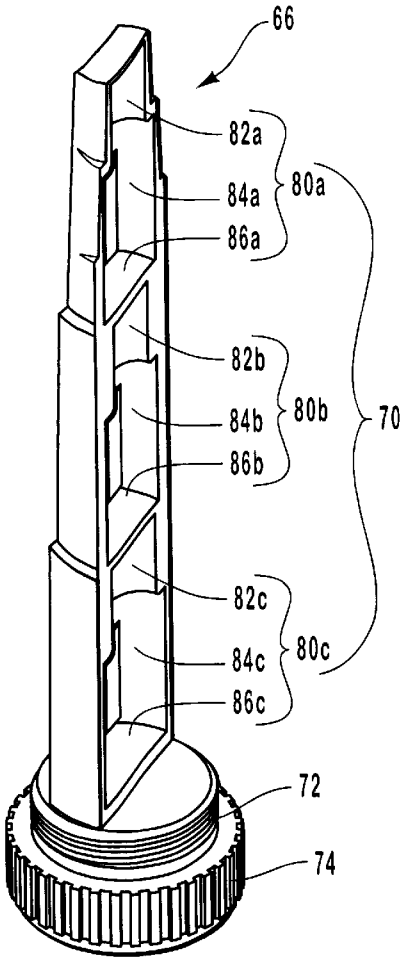
FIG. 3A is a perspective of the tray of an embodiment of the present invention.
Figure 4B:
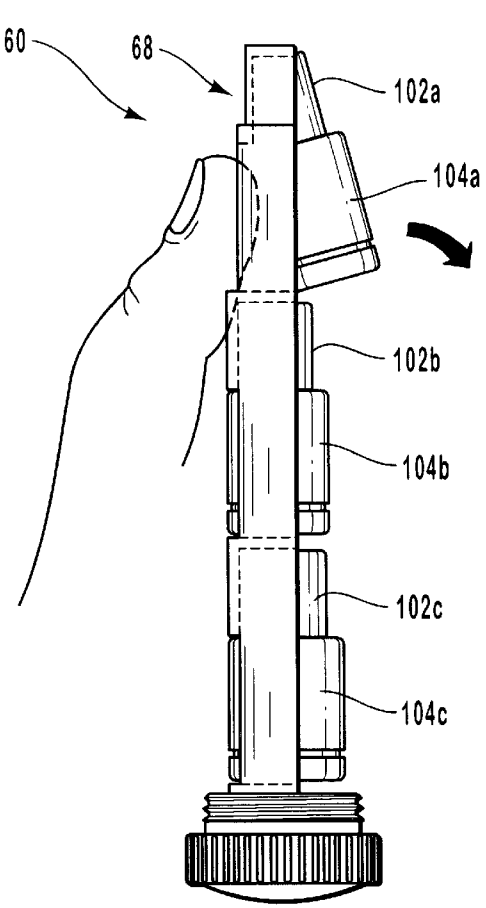
FIG. 4B is a side view of a tray with one set of nested sockets being pushed out of the tray.
Figure 4A:
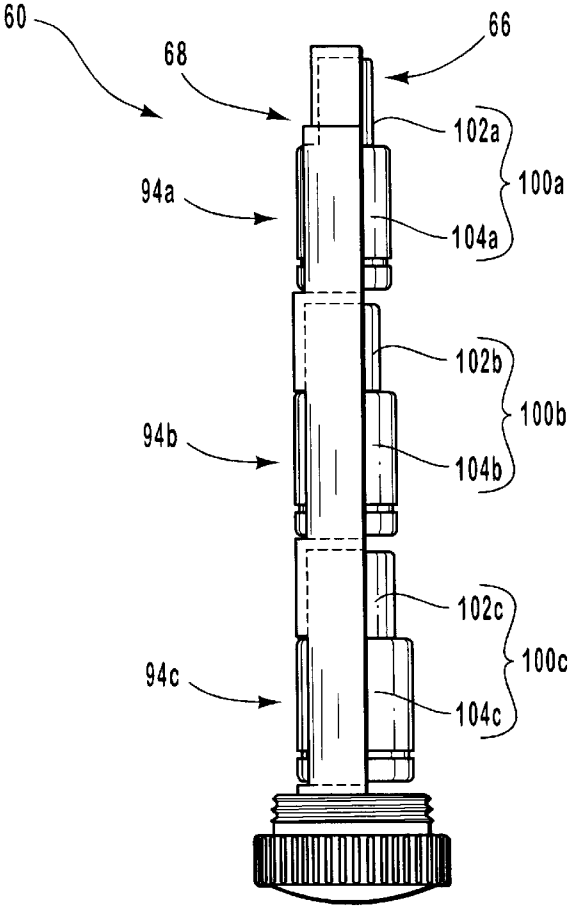
FIG. 4A is a side view showing a tray loaded with sets of nested sockets.
Figure 5C:
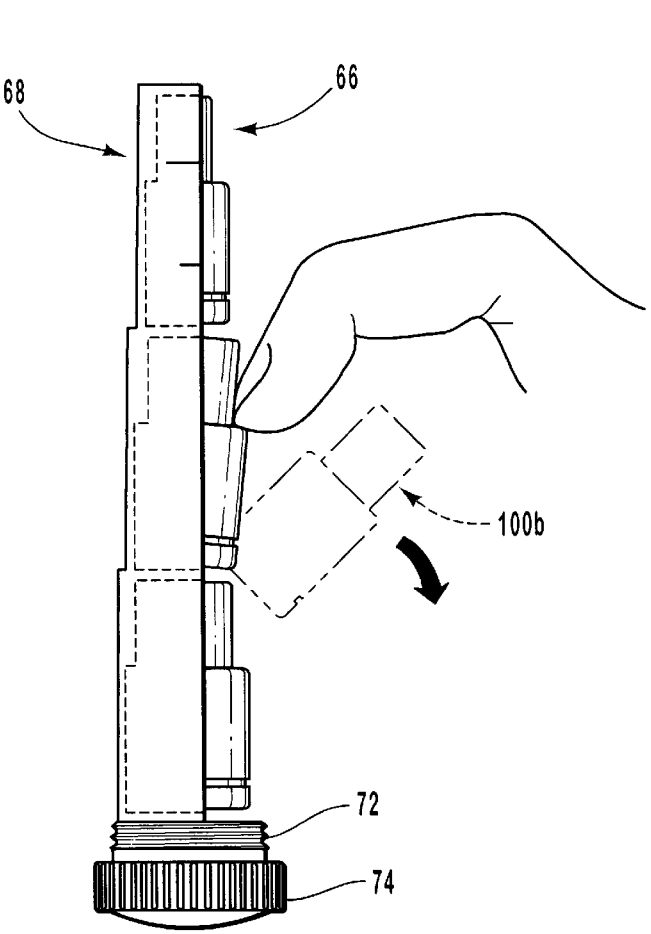
FIG. 5C is a side view of a tray of an alternative embodiment of the present invention showing a set of sockets being pulled from the tray.
Figure 5B:
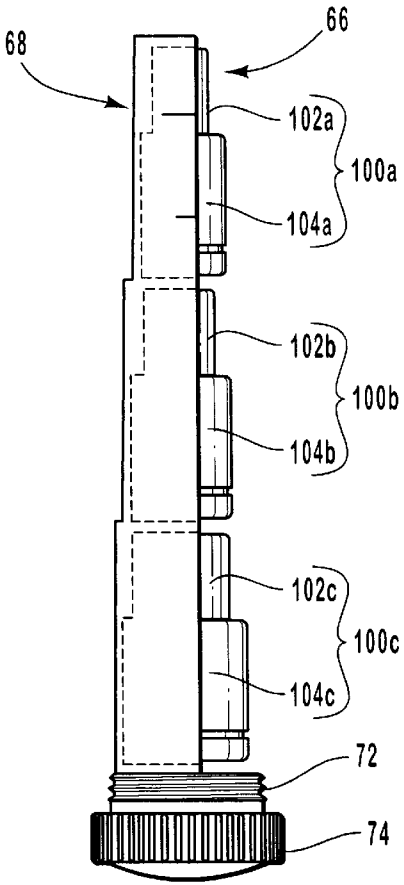
FIG. 5B is a side view of a tray of an alternative embodiment of the present invention storing nested sockets.
Figure 5A:
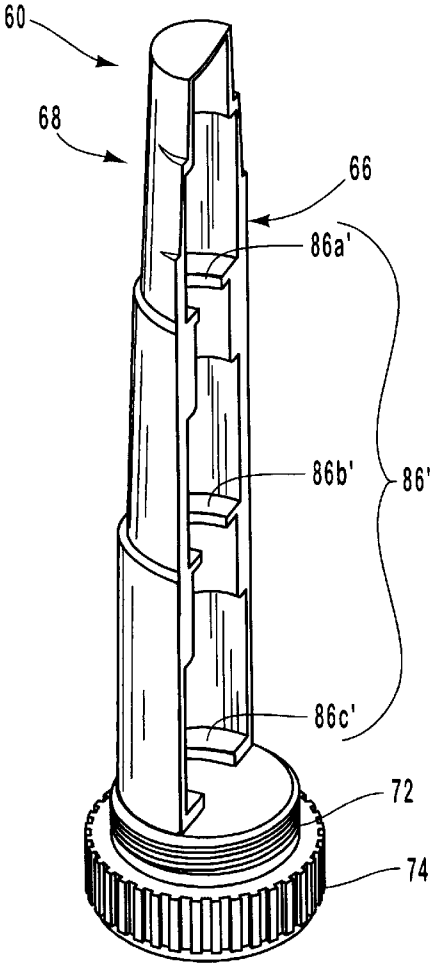
FIG. 5A is a perspective view of a tray of an alternative embodiment of the present invention.
Figure 6B:
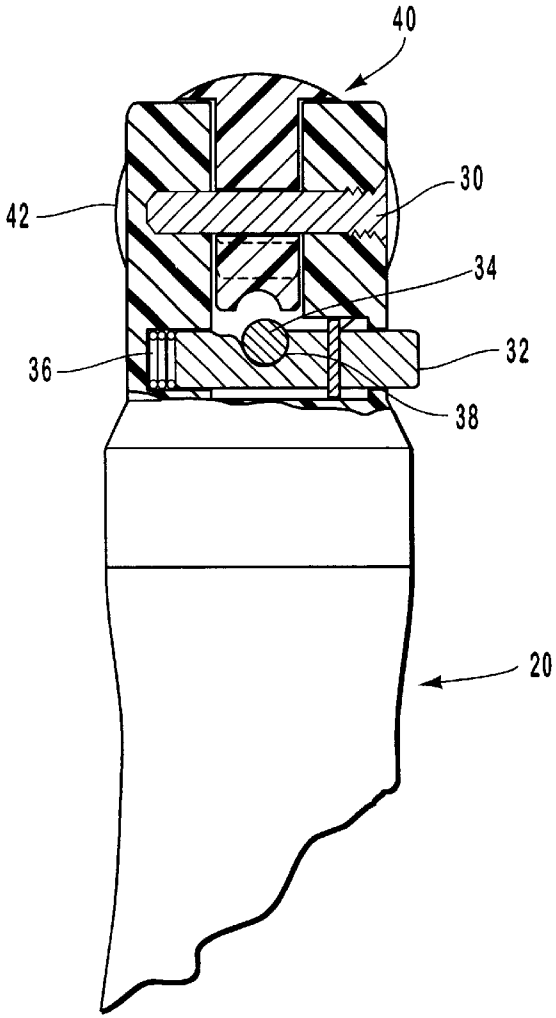
FIG. 6B is a partial sectional side view illustrating the operation of the pivot pin.
Figure 6A:
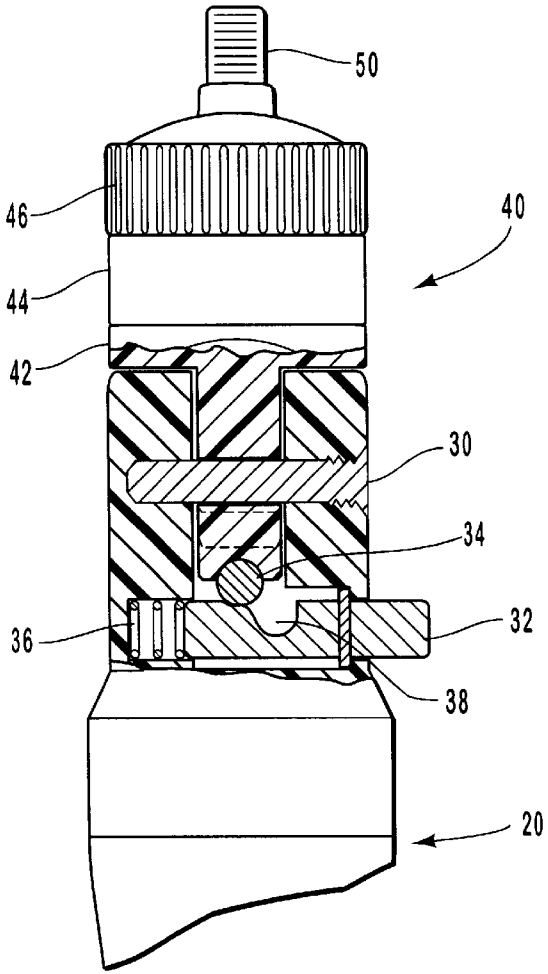
FIG. 6A is partial sectional side view illustrating the operation of the pivot pin between the head and handle of the ratchet wrench.

FIG. 1 shows a perspective view of a preferred embodiment assembled and ready to use. FIG. 2 is an exploded perspective view of the same embodiment. FIGS. 3A, 3B and 3C depict tray 60 of the embodiment illustrated in FIGS. 1 and 2. FIG. 4A depicts tray 60 loaded with sockets 100. FIG. 4B depicts a set of sockets 100*a* being removed from tray 60 loaded with sockets 100. FIGS. 5A, 5B and 5C show another embodiment in which tray 60 provides access to sockets 100 only from open side 66. FIGS. 6A and 6B show a pivot pin 30 connecting head 40 and handle 20 which enables head 40 to pivot relative to handle 20.

Referring more particularly to the drawings, the perspective view of FIG. 1 shows wrench 10 having a head 40, a handle 20, and a pivot pin 30 connecting head 40 and handle 20. The exploded perspective view of FIG. 2 shows wrench 10 in greater detail. Head 40 has a socket mounting stub 50 sized to receive a socket 104*c*. The mechanism that enables head 40 to pivot relative to handle 20 is described in detail below with reference to FIGS. 6A and 6B.

The handle 20 is operably connected to head 40 and defines a chamber 28. Handle 20 has a curved shape, enabling it to be easily grasped. Handle 20 is an example of handle means for defining a chamber.

Tray 60, adapted to store sockets 100, is sized to slide into chamber 28. Tray 60 is an example of means for storing sockets in the chamber. As shown in FIG. 2, tray 60 has an insertion end 62 which slides into chamber 28 so that insertion end 62 is in close proximity with the closed end of chamber 28. Tray 60 and chamber 28 preferably have corresponding cylindrical shapes. Tray 60 and handle 20 are adapted to securely engage tray 60 and handle 20 together, keeping tray 60 inside handle 20 during use. Tray 60 also has an engagement end 74 with threads 72 that engage corresponding threads 26 inside chamber 28 to securely fasten tray 60 in handle 20. In an alternative embodiment, engagement end 74 and handle 20 may have corresponding ribs to snap tray 60 securely into handle 20. Alternatively, chamber 28 of handle 20 may have a tapered shape that holds tray 60 in place. Threads 72, ribs and the tapered shape of chamber 28 are examples of means for engaging the handle and the tray together so that the tray remains in the handle during use. Engagement end 74 is ridged or textured to enable tray 60 to be grasped and removed from chamber 28. Tray 60 is tapered at insertion end 74 to correspond with a curved region 22 of handle 20. As discussed above, the curved shape of handle 20 enables handle 20 to be easily grasped.

Tray 60 has a stepped slot 70 accessible from an open side 66 of tray 60. Stepped slot 70 is adapted to retain at least a first set of nested sockets 100*a* until removal of one of sockets 102*a*, 104*a* is desired. Stepped slot 70 of the illustrated embodiment stores three sets of nested sockets, 100*a*, 100*b*, 100*c*, each with a first socket 104*a*, 104*b*, 104*c*, (collectively and generically 104), and a smaller nested socket 102*a*, 102*b*, 102*c*, (collectively and generically 102). Stepped slot 70 is an example of means for retaining at least a first set of sockets in a nested configuration until removal from the tray is desired. One advantage of storing sockets in a stepped slot, such as stepped slot 70, is that sockets 100 are visible and easily accessed and loaded from open side 66 of tray 60, without interfering straps or lips. Another advantage of storing sockets in stepped slot 70 is that it retains sockets 100 without lips or other extensions that could be easily broken off tray 60.

Referring now to the embodiment illustrated in FIG. 3A, stepped slot 70 is divided into three cells 80*a*, 80*b*, 80*c* (collectively and generically 80). While the illustrated embodiment has three cells 80, alternative embodiments may have any number of cells 80, depending how many sockets 100 the embodiment is configured to store. Each cell 80 has a platform 86*a*, 86*b*, 86*c* (collectively and generically 86). Platform 86 is an example of a divider running from one side of tray 60 to the other. In an alternative embodiment, shown in FIG. 5A, the dividers are ledges 86' that extend into stepped slot 70. One advantage of this feature is that platforms 86 help stepped slot 70 retain sets of nested sockets 100*a*, 100*b*, 100*c* when a socket 100 adjacent to platform 86 becomes partially dislodged. These dividers are examples of means for dividing the stepped slot into cells.

Each cell 80 preferably has a narrow receptacle, 82*a*, 82*b*, 82*c*, (collectively and generically 82), and a wide receptacle 84*a*, 84*b*, 84*c*, (collectively and generically 84). Each receptacle 82, 84 is sized and shaped to support and grip a socket 100. Together, each set of narrow receptacle 82 and wide receptacle 84 receive set of sockets 100*a*, 100*b*, 100*c* in a nested configuration. In the illustrated embodiment, sets of nested sockets 100*a*, 100*b*, 100*c* are pairs. In alternative embodiments, sets of nested sockets 100*a*, 100*b*, 100*c* contain three or more sockets. In these alternative embodiments, cells 80 have at least one mid-sized receptacle, intermediately sized between narrow receptacle 82 and wide receptacle 84, enabling each cell 80 to retain sets of nested sockets 100*a*, 100*b*, 100*c* of more than two sockets 100.

Sockets 100 are gripped sufficiently tightly so that each set of nested sockets 100*a*, 100*b*, 100*c* remains in tray 60 when tray 60 is handled. Sockets 100 may also be gripped sufficiently tightly so that each set of nested sockets 100*a*, 100*b*, 100*c* remains in tray 60 when tray 60 faces downward. To store sockets 100 in tray 60, each set of nested sockets 100*a*, 100*b*, 100*c* is pressed into cell 80*a*, 80*b*, 80*c* corresponding to the size of set of nested sockets 100*a*, 100*b*, 100*c*. In alternative embodiments, only one of receptacles 82, 84 is adapted to grip one socket 102 in a set of nested sockets 100*a*, 100*b*, 100*c*.

In the illustrated embodiment, each receptacle 82, 84 is molded to fit a socket 100. This shape enables receptacles 82, 84 to grip sockets 100 and retain sets of nested sockets 100*a*, 100*b*, 100*c* in tray 60. Receptacles 82, 84 may be tapered to provide a frictional engagement with sockets 100. Receptacles 82, 84 may also be slightly flexible and sized slightly smaller than respective sockets 100 so that the sidewalls of receptacles 82, 84 flex upon insertion of sockets 100 and grip the sockets 100. Any kind of frictional engagement may be utilized. By retaining sets of nested sockets 100*a*, 100*b*, 100*c*, tray 60 retains sockets 100 compactly.

In contrast to prior art devices that store sockets on a tray with lips or other extensions of the tray, in the present invention, the sidewalls of receptacles 82, 84 are flush with the flat top surface of open side 66 of tray 60. Being flush with the flat top surface of open side 66 enables the sidewalls of receptacles 82, 84 to slightly flex as needed without risk of damaging the sidewalls of receptacles. In addition, the shape of receptacles 84, 82, tapered and/or molded to fit, grips sockets 100 in a visible and easily accessible manner.

In one embodiment, each receptacle 82, 84 grips the respective sockets with approximately equal force. In another embodiment, narrow receptacle 82 exerts a greater grip on socket 102 than the grip exerted by wide receptacle 84 on a larger socket 104. Because it is less tightly gripped, larger socket 104 can be easily dislodged from wide receptacle 84. More firmly held smaller socket 102 will remain gripped by narrow receptacle 82 until larger socket 104 swings away from tray 60, bringing smaller socket 102 out of the grip of narrow receptacle 82. In alternative embodiments, wide receptacle 84 exerts a tighter grip on a socket 104 in set of nested sockets 100*a*, 100*b*, 100*c* than smaller receptacle 82 exerts on smaller, nested socket 102 of set of nested sockets 100*a*, 100*b*, 100*c*.

The advantage of storing nested sockets 100 is that a loosely gripped socket 104 can make set of nested sockets 100*a*, 100*b*, 100*c* easily removable while more tightly gripped smaller socket 102 secures to the tray sockets 100 nested in smaller socket 102. Alternatively, if sockets 100 are gripped equally, larger sockets 104 will still be more easily grasped than smaller sockets 102 and can be dislodged to remove smaller sockets 102. Thus, the nested configuration makes smaller sockets 102 easily removable. A further advantage of storing sockets 100 in a nested configuration is that sockets 100 are stored more compactly than the same number of sockets stored individually.

Each cell 80 stores sets of nested sockets 100*a*, 100*b*, 100*c* with sockets 100 having a size ratio that is sufficient to enable socket 102 to be nested in another socket 104. The present invention preferably stores sockets 100 having a size ratio ranging from approximately 1.5:1 to 2:1, more preferably from 1.6:1 to 1.75:1. However, the ratio may be greater than 2:1. The tray of the illustrated embodiment stores three sets of nested sockets 100*a*, 100*b*, 100*c* of the following sizes: (1) a 9/16 socket and a 11/32 socket, which is a 1.6:1 ratio; (2) a ½ and 5/16 socket, which is a 1.6:1 ratio; and (3) a 7/16 socket and a ¼ socket, which is a 1.75:1 ratio.

As shown in FIGS. 3B and 3C, back side 68 of tray 60 defines three apertures 94*a*, 94*b*, 94 (collectively and generically 94), one per cell 80. Each aperture 94 is positioned to correspond with a storage position of a first socket 104 in set of nested sockets 100*a*, 100*b*, 100*c*. FIG. 3C shows a side view of tray 60 of the same embodiment. Alternatively, apertures 94 could correspond to the position of either or all sockets 100 in each set of nested of sockets 100*a*, 100*b*, 100*c*.

FIG. 4A shows tray 60 with three apertures 94 and sockets 100 loaded on tray 60. Apertures 94 expose sockets 104 from back side 68 of tray 60. FIG. 4B shows tray 60 with a set of sockets 100*a* being removed. As shown in FIG. 4B, each aperture 94 enables corresponding exposed socket 104 to be pushed from back side 68 of tray 60 dislodging exposed socket 104. Because sockets 100 are stored in nested sets 100*a*, 100*b*, 100*c*, dislodging loosely gripped, exposed socket 104 enables removal of entire set of nested sockets 100*a*, 100*b*, 100*c* to be achieved with minimal effort, even if smaller socket 102 in set of nested sockets 100*a*, 100*b*, 100*c* is firmly gripped. As shown in FIG. 4B, once one socket, such as socket 104*a*, is dislodged, corresponding set of nested sockets 100*a* can be easily grasped and pivoted away from tray 60 for removal. The same advantage is applicable to sets of sockets 102*b*, 100*c*.

Referring now to FIGS. 5A, 5B and 5C, an alternative embodiment is shown in which tray 60' has open side 66' but no apertures 94 to expose sockets 100 through back side 68' of tray 60'. In the embodiment depicted in FIG. 5A, cells 80' have ledges 86*a*', 86*b*', 86*c*' extending from the sides of tray 60'. Alternatively, ledges 86*a*' 86*b*' may be flush with respective narrow receptacles 82*b* and 82*c*. FIG. 5B shows a side view of an alternative embodiment loaded with sockets 100. FIG. 5C shows a set of nested sockets 100*b* being removed from tray 60. Sets of nested sockets 100*a*, 100*b*, 100*c* are removed by pulling larger sockets 104 from tray 60.

FIGS. 6A and 6B are partial sectional views of a preferred embodiment of the present invention. FIG. 6A shows head 40 of ratchet wrench 10 in a locked position. Head 40 of ratchet wrench 10 has a ratchet mechanism 44 with a ridged or textured rim 46. The components of ratcheting mechanism 44 are the subject of U.S. patent application Ser. No. 09/659,053, filed on Sep. 11, 2000 which is hereby incorporated by reference.

Head 40 and handle 20 of the preferred embodiment are connected to each other by a pivot pin 30. Head 40 has a base 42 that drops down against a ball bearing 34. Pivot pin 30 is operated by depressing a pivot arm 32 which is propped open by a spring 36. As shown in FIG. 6B, once pivot arm 32 is depressed, a ball bearing 34 drops into a notch 38 in pivot arm 32, enabling base 42 and attached head 40 to pivot relative to handle 20. In an alternative embodiment, handle 20 connects head 40 via a neck.

From the above discussion, it will be clear that the wrench of the present invention stores sockets in a compact, easily accessible and relatively secure manner. Storing sockets in nested sets enables the sockets to be visible, easily loaded and easy to remove. Furthermore, storing sockets within the handle of the wrench enables the user to easily and with one hand carry both the wrench and a number of sockets for use with the wrench. This feature makes misplacing or losing the sockets less likely.

The wrench of the present invention may be part of a system to store a variety of tool members. The systems preferably includes a handtool such as a wrench 10 and a set of two or more interchangeable trays. A first tray is adapted to retain standard sockets; a second tray is adapted to retain metric sockets; and a third tray is adapted to retain screwdriver bits.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

It will be obvious to those having skill in the art that many changes may be made to the details of the above-described embodiments of this invention without departing from the underlying principles thereof. The scope of the present invention should, therefore, be determined only by the following claims.

What is claimed and desired to be secured by United States Letters Patent is:

1. A wrench adapted to compactly store sockets comprising:

a head having means for mounting sockets;

handle means for defining a chamber, wherein the handle means is operably connected to the head; and means for storing sockets in the chamber;

wherein the storing means has means for retaining at least two separate sets of sockets in nested configurations until removal from the storing means is desired;

wherein the retaining means is accessible from an open side of the storing means; and wherein the storing means and the handle means have means for engaging the handle means and storing means so that the storing means remains in the handle means during use.

2. The wrench of claim 1 wherein the means for storing sockets is a tray.

3. The wrench of claim 1 wherein the retaining means is a stepped slot.

4. The wrench of claim 1 further comprising means for dividing the retaining means into cells.

5. The wrench of claim 2 wherein the tray defines an aperture positioned to correspond to a first socket in the first set of sockets which facilitates dislodging the first socket so that the first set of sockets is easily removed from the tray.

6. A wrench adapted to compactly store sockets comprising:

a head having a socket mounting stub;

a handle operably connected to the head, wherein the handle defines a chamber;

a tray adapted to be positioned in the chamber;

wherein the tray has a stepped slot that is accessible from an open side of the tray;

wherein the stepped slot is adapted so that the stepped slot retains at least two separate sets of sockets in nested configurations until removal from the tray is desired;

wherein the tray and the handle are adapted to be securely engaged together so that the tray remains in the handle during use.

7. The wrench of claim 6 wherein the tray defines an aperture positioned to correspond with the placement of the first set of sockets to facilitate dislodging at least one of the sockets in the first set of sockets.

8. The wrench of claim 6 wherein the stepped slot has a narrow receptacle and a wide receptacle;

wherein each receptacle is sized to support a socket; and wherein one of the receptacles is adapted to grip a socket.

9. The wrench of claim 8 wherein the narrow receptacle and the wide receptacle are each adapted to grip a socket;

wherein one of the receptacles is adapted to exert a tighter grip on a socket than the other receptacle.

10. The wrench of claim 8 wherein the narrow receptacle and the wide receptacle are a cell; and wherein the tray has a plurality of cells.

11. The wrench of claim 7 wherein the stepped slot has a receptacle that is adapted to grip a socket in the first set of sockets in a nested configuration and enables the set of sockets to be held in place when the open side of the tray faces downward.

12. The wrench of claim 8 wherein at least one of the receptacles is slightly flexible and sized to enable the socket to be snapped into the receptacle.

13. The wrench of claim 8 wherein at least one of the receptacles is tapered.

14. The wrench of claim 6 wherein the stepped slot is accessible from only the open side of the tray.

15. The wrench of claim 6 wherein the tray has an engagement end;

wherein the engagement end and the chamber have corresponding mated threads that enable the engagement end to securely engage the handle so that the tray remains in the handle during use.

16. A wrench adapted to compactly store sockets comprising:

a head having means for mounting sockets;

handle means for defining a chamber, wherein the handle means is operably connected to the head; and means for storing sockets in the chamber;

wherein the storing means has means for retaining at least a first set of sockets in a nested configuration until removal from the tray is desired;

wherein the retaining means is accessible from an open side of the storing means;

wherein the retaining means is stepped and is divided into cells;

wherein the storing means has an aperture that corresponds to the position of the first set of sockets and facilitates dislodging at least one of the sockets in the first set of sockets so that the first set of sockets is easily removed from the tray; and wherein the storing means and the handle means have means for engaging the handle means and storing means together so that the storing means remains in the handle means during use.

17. The wrench of claim 16 wherein the retaining means has a narrow receptacle and a wide receptacle, each adapted to grip a socket enabling the set of sockets to be retained in the retaining means.

18. A wrench adapted to compactly store sockets comprising:

a head having a socket mounting stub;

a handle operably connected to the head, wherein the handle defines a chamber;

a tray sized to be positioned in the chamber;

wherein the tray has a stepped slot that is accessible from an open side of the tray;

wherein the stepped slot has a plurality of cells, each cell being adapted to retain a set of sockets in a nested configuration until removal from the tray is desired;

wherein the tray has a back side configured such that one of the sockets in each set of sockets is exposed through the back side of the tray, enabling the set of sockets to be easily removed by pushing the exposed socket out of the cell; and wherein the tray and the handle are adapted to securely engage together so that the tray remains in the handle during use.

19. The wrench of claim 18 wherein the stepped slot has three cells and three apertures, each aperture corresponding to the position of one of the cells.

20. A wrench adapted to compactly store sockets comprising:

a head having a socket mounting stub;

a handle operably connected to the head, wherein the handle defines a chamber;

a tray sized to slide into the chamber;

wherein the tray has a stepped slot that is accessible from an open side of the tray;

wherein the stepped slot is adapted to retain at least a first set of sockets in a nested configuration;

wherein the stepped slot has a narrow receptacle and a wide receptacle, each adapted to grip a socket; which enables the set of sockets to be retained in the stepped slot until removal from the tray is desired;

wherein one of the receptacles is adapted to exert a tighter grip on a socket than the other receptacle;

wherein the tray and the handle are adapted to securely engage together so that the tray remains in the handle during use.

21. The wrench of claim 20 wherein the tray defines at least one aperture that corresponds to the position of the first set of sockets and facilitates dislodging at least one of the sockets in the set of sockets to be dislodged so that the set of sockets is easily removed from the tray.

22. A wrench adapted to compactly store sockets comprising:

a head having a socket mounting stub;

a handle operably connected to the head, wherein the handle defines a chamber;

a tray sized to be positioned in the chamber;

wherein the tray has a stepped slot that is accessible from an open side of the tray;

wherein the stepped slot has a plurality of cells, each cell being adapted to retain a set of sockets in a nested configuration until removal from the tray is desired;

wherein the tray has a back side configured such that at least a portion of at least one of the sockets in each set of sockets is exposed through an aperture in the back side of the tray to allow for each set of nested sockets to be dislodged from the tray by way of the aperture; and wherein the cells are adapted such that dislodging the exposed socket in each set of sockets at least partially dislodges each of the remaining sockets in the set.

* * * * *